US005129569A

United States Patent [19]

Stanton

[11] Patent Number: 5,129,569

[45] Date of Patent: Jul. 14, 1992

[54] APPARATUS TO ATTACH A FLEXIBLE COVERING TO A SEMI-RIGID MEMBER

[76] Inventor: Norman C. Stanton, 30950 S.W. River La., West Linn, Oreg. 97068

[21] Appl. No.: 455,513

[22] Filed: Dec. 21, 1989

[51] Int. Cl.[5] ..... B27F 7/26; B27F 17/13

[52] U.S. Cl. ..... 227/43; 227/25; 227/39; 227/44

[58] Field of Search ..... 227/12, 13, 20, 25, 227/39, 44

[56] References Cited

U.S. PATENT DOCUMENTS

| | | | |
|---|---|---|---|
| 2,947,001 | 8/1960 | Kamborian | 227/13 |
| 3,086,209 | 4/1963 | Kamborian | 227/13 |
| 3,193,164 | 7/1965 | Frasier | 227/39 X |
| 3,527,397 | 9/1970 | Wortsmith | 227/13 |
| 3,583,295 | 6/1971 | Elder et al. | 227/20 X |
| 4,478,361 | 10/1984 | McElhannon | 29/832 |
| 4,610,083 | 9/1986 | Campisi et al. | 227/7 |
| 4,809,899 | 3/1989 | Resta et al. | 227/25 |

*Primary Examiner*—Paul A. Bell
*Attorney, Agent, or Firm*—Klarquist, Sparkmen, Campbell, Leigh & Whinston

[57] ABSTRACT

This invention discloses an apparatus to staple a fabric covering to the framework of a box spring. A table having low friction rollers on the top surface supports a box spring in an inverted position. The box spring resides inside a fabric covering which extends about the box spring and has an upstanding flap of fabric. A plurality of drive wheels are mounted above the table to engage the box spring and propel the box spring through the apparatus. A pair of subframes are located above the box spring to position the box spring and to guide the box spring through the apparatus. Guides attached to each subframe center the box spring in the apparatus and simultaneously fold the upstanding flap of fabric down upon the box spring. A staple gun is attached to each subframe to drive staples through the fabric covering into the box spring, thus attaching the fabric to the box spring.

8 Claims, 3 Drawing Sheets

APPARATUS TO ATTACH A FLEXIBLE COVERING TO A SEMI-RIGID MEMBER

TECHNICAL FIELD

This invention relates to a method and apparatus to attach a flexible covering to a semi-rigid body. Specifically this invention applies to a method and apparatus to attach a fabric cover to a box spring assembly.

BACKGROUND OF THE INVENTION

Box spring assemblies may be as simple as a fabric covering over a simple wooden framework. More typically, a box spring assembly has a lower wooden framework to which is attached a plurality of spring elements. These spring elements are selectively attached to one another to form a unified structure. Padding, usually quilted to a decorative fabric, covers the top surface of the spring elements to form a top cover. An additional side fabric portion is sewn to this top cover to extend about the sides of the box spring assembly. This side fabric portion is typically attached to the wooden framework on the bottom of the box spring assembly. This side fabric portion is attached to the wooden framework by staples, nails, tacks or adhesive. The attachment operation is usually performed manually by inverting the box spring, pulling the fabric covering tight and stapling the fabric to the wooden framework. This manual operation is expensive because it is labor intensive and the quality of the attachment is dependent upon the operator.

Several devices have been developed to attach flexible coverings, such as fabric, to semi-rigid or rigid members, such as the framework of box springs. One of the problems with an automated assembly machine is the variety of sizes of box springs which need to be accommodated. Box springs are manufactured in at least four standard sizes with a host of non-standard sizes. Typical standard sizes are: single or twin, which is thirty eight (38) inches by seventy four (74) inches; full or double, which is fifty three (53) inches by seventy four (74) inches; queen, which is sixty (60) inches by eighty (80) inches; and king, which uses two box springs measuring thirty eight (38) inches by eighty (80) inches each. The thickness of the box springs is not as standardized as the length and width. The thickness of the box spring is dependent upon the type of support elements and the type and thickness of the top cover.

An apparatus to attach a flexible cover to a semi-rigid member is disclosed in Wortsmith, U.S. Pat. No. 3,527,397. The '397 patent discloses a machine used to staple a covering to a kneeling bench. A fixed height table supports a fixture holding the elements to be assembled. A series of drive wheels are located on the table with a series of non-driven rollers positioned parallel to the drive wheels to complete the table top. A series of pressure wheels are located above the table to compress the article to be assembled. Rotating brushes turn the flexible covering down upon the frame, whereupon a pair of staple guns oscillate up and down to force a staple through the covering fabric into the frame each time the staple guns strike the article. Adjustment of the machine for different size articles, although possible, is time consuming because each element of the machine must be adjusted separately.

DISCLOSURE OF THE INVENTION

The present invention consists of two cooperating units. The first unit is a table on which to support a box spring assembly. The table has a series of low friction rollers transversely located down the length of the table. The table is adjustable in a vertical position, such that the table remains parallel to the floor while it is raised and lowered.

The second cooperating unit is an attachment assembly which has a framework upon which are mounted two rotatable shafts. The framework extends beyond the table and is independent of the table. The rotatable shafts are spaced apart, across and above the table, near the center of the table with one shaft defining an upstream side and the other shaft defining a down stream side. Both shafts are driven by a common motor. Each shaft rotates in the same rotational direction and at the same rotational speed.

Each shaft has a pair of drive wheels coupled to the shaft, such that the drive wheels rotate with the shaft. The drive wheels are positioned laterally across the rotating shafts to contact a box spring which is supported by the table and to propel the box spring through the attachment assembly along the table.

Two attachment subassemblies cooperate with the drive wheels to guide the box spring through the attachment assembly, fold a fabric flap down upon the box spring, tension the fabric flap and attach the fabric to the box spring. At least one of the attachment subassemblies is supported on a subframe mounted on the shafts and is adjustable across the shafts. The drive wheels associated with the adjustable attachment subassembly are connected to the subassembly and move laterally with the subassembly when it is adjusted. The second subassembly may be rigidly mounted to the framework of the attachment assembly or may be supported by the shafts and be adjustable across the shafts. This lateral adjustment allows various width box springs to be accommodated.

Each of the attachment subassemblies includes side guides to position the box spring. A fabric turning guide and a fabric turning roller is mounted on each attachment subassembly upstream of the drive wheel mounted on the upstream rotatable shaft. A fabric tensioning roller is mounted downstream of the upstream rotatable shaft to smooth any wrinkles in the fabric and to tension the fabric about the box spring. A stapler is mounted on each attachment subassembly downstream of the tensioning roller to drive staples through the fabric into the box spring. The drive wheels mounted on the downstream rotatable shaft are downstream of the staplers to propel the box spring out of the attachment assembly.

It is an object of the invention to provide an apparatus to attach a flexible covering to a semi-rigid member.

It is another object of the invention to provide a semi-automatic apparatus to attach a flexible covering to a variety of semi-rigid members of various dimensions.

It is a further object of the invention to provide an apparatus which can attach a flexible covering to a semi-rigid member wherein, the apparatus is easily adjustable to accommodate different size semi-rigid members.

Yet another object of the invention is to provide a semi-automatic apparatus to attach loose gathers of a flexible covering to side or end rails of a semi-rigid member, such that the loose gathers are pulled tautly over the rails and attached thereto with essentially no wrinkles.

Other objects and advantages of the present invention will be apparent from the following description of a preferred embodiment thereof and from the attached drawings.

DETAILED DESCRIPTION OF THE INVENTION

Figure 1:
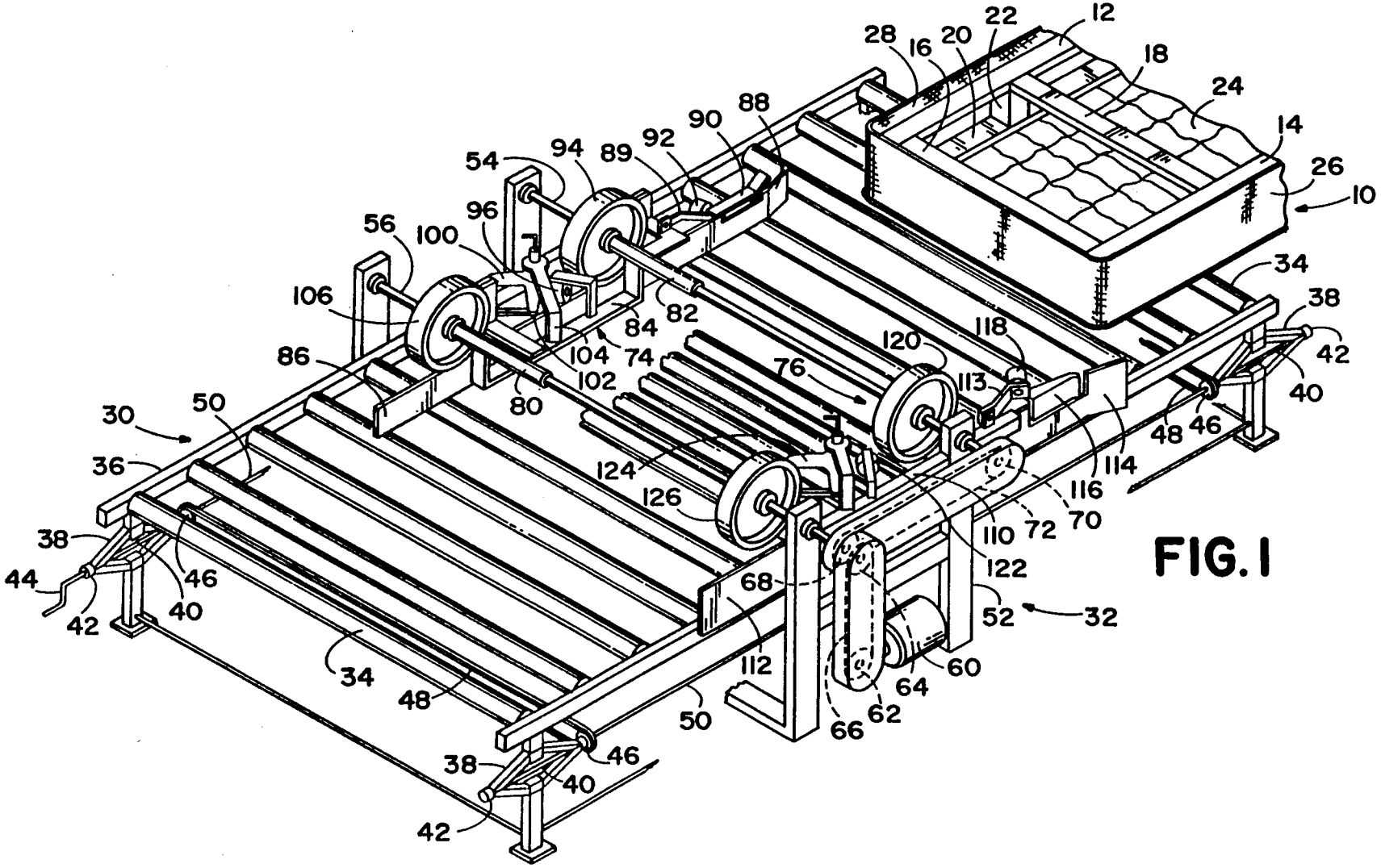
FIG. 1 is a perspective view of a table and one assembly station of the present invention.

Referring to FIG. 1, a partial box spring assembly 10 is shown in detail. In its simplest form, the box spring assembly 10 has a lower wooden framework consisting of side rails 12 and 14 interconnected by a head cross rail 16 and a foot cross rail (not shown). Various other cross rails 18 may be added parallel to the head cross rail 16 to form a lower integrated wooden framework. An upper wooden framework constructed similar to the lower wooden framework includes the side rail 20. Vertical wooden members 22 interconnect the upper wooden framework with the lower wooden framework. The wooden framework rests inside a flexible fabric covering. The flexible fabric covering includes a top cover 24, which may be a quilted, decorative fabric covering. A side fabric cover 26 is sewn to the top cover 24 to form an open sleeve-like cover. The side fabric cover 26 extends above the rails of the wooden framework to form an upstanding flap 28. The box spring assembly 10 rests in an inverted position upon a support table 30.

The apparatus of the present invention consists of two cooperating units 30 and 32. The first cooperating unit 30 is a support table. Support table 30 consists of a series of parallel mounted support rollers 34 attached to a frame 36. The rollers 34 are attached to the table 30, perpendicular to the direction of travel of the box spring. The frame 36 is attached at each of its four corners to scissors jacks 38. The scissors jacks 38 are conventional scissors jacks as are known in the art and include a screw 40 and a nut 42. Rotation of the screw 40 causes the nut 42 to travel along the screw. A handle 44 is attached to one of the scissors jacks 38, such that rotation of the handle 44 will cause the scissor jack to expand or contract in a vertical direction. Each scissors jack 38 has a sprocket 46 attached to the jack. Sprockets 46 are interconnected by a chain 48. This interconnects the jacks in a side-to-side relationship. A rod 50 interconnects the jacks in longitudinal relationship. In this manner, rotation of a single handle 44 causes all four jacks to act simultaneously. Rotation in one rotational direction will cause all four jacks to raise the table in a vertical position, maintaining the table parallel to the ground. Rotation of hand crank 44 in the opposite direction will cause the table to be lowered uniformly parallel to the ground. Other vertical adjustment means are possible in alternate embodiments of this invention. Hydraulic cylinders or screw jacks may be used in place of the scissors jacks just described.

The second cooperating unit is an attachment assembly 32. Attachment assembly 32 has a frame 52 which extends below and to the sides of the support table 30. This frame 52 is wider than and is independent of the support table 30. Attached to the frame 52 are two rotatable shafts 54 and 56. These rotatable shafts 54 and 56 are above and extend across the support table 30. Shafts 54 and 56 are generally parallel to the low friction support rollers 34 of the table. The framework 52 is centrally located along the length of the support table 30. The first rotatable shaft 54 is an upstream shaft and the second rotatable shaft 56 is a downstream rotatable shaft. The upstream side is the direction from which the box spring assembly 10 enters the attachment assembly 32, as shown by the direction of the arrow in FIG. 1.

Rotatable shafts 54 and 56 are driven by a single motor 60. A sprocket 62 is driven by motor 60 and interconnects with another sprocket 64 attached to rotatable shaft 56. Sprocket 62 and 64 are interconnected by a chain 66. An additional sprocket 68 is attached to rotatable shaft 56. A mating sprocket 70 is attached to rotatable shaft 54. Sprockets 68 and 70 are interconnected by a chain 72. Thus, rotation of the motor 60 will cause both rotatable shafts 54 and 56 to rotate in the same direction at the same rotational speed.

Cooperating with the rotatable shafts 54 and 56 are a first attachment subassembly 74 and a second attachment subassembly 76.

Referring now the first attachment subassembly 74, it can be seen that a first hollow tubular member 80 lies about the second rotatable shaft 56. A second hollow tubular member 82 lies about the first rotatable shaft 54. Interconnecting and supported by hollow tubular members 80 and 82 is a subframe 84. Attached to the subframe 84 is a lateral positioning side guide 86. The side guide 86 extends between and beyond both the rotatable shafts 54 and 56. The upstream end of the lateral side guide 86 is bent outward to form an entrance portion 88 of the lateral positioning side guide 86. Also attached to subframe 84 is a bracket 89, which holds a sheet metal fabric turning guide 90 and a fabric turning roller 92. Bracket 89 may be adjustable or it may be spring loaded in the down position, thus forcing the fabric turning guide down toward the entrance portion 88 of the lateral side guide 86. The fabric turning guide 90 is formed in such a manner that the flap 28 of the side covering 26 will begin to be folded down toward the center of the box spring assembly 10 upon a side rail 12. The fabric turning roller 92 is attached to the bracket 89 at an angle relative to the longitudinal direction of motion of the box spring assembly 10. In this manner, the fabric turning roller forces the fabric flap 28 down upon the side rail 12.

An entrance drive wheel 94 is attached to rotatable shaft 54, such that the drive wheel 94 rotates with shaft 54. This drive wheel may be pneumatic, semi-pneumatic or have a solid rubber surface on the wheel. Entrance drive wheel 94 is adjusted laterally across shaft 54, so that it contacts the box spring 10 in the area of the side rail 12. The support table assembly 30 has previously been adjusted in a vertical position, so that drive wheel 94 when it contacts the box spring assembly 10 imparts a slight downward pressure on the box spring assembly somewhat compressing the box spring. This insures that the side portion 26 of the fabric covering will be tight about the sides of the box spring. The drive wheel contacts the downturned flap 28 sitting upon the side rail 12 and forces the box spring assembly into the attachment assembly 32. The box spring assembly 10 continues to travel lengthwise down the support table 30 until the fabric flap 28 is contacted by a non-driven fabric tension roller 96. The fabric tension roller 96 is rotationally supported by a bracket attached to the subframe 84. The axis of the tensioning roller 96 is at an angle to the direction of travel of the box spring 10. As the box spring assembly 10 progresses down the support table 30, the roller pulls the fabric flap 20 inward toward the center of the box spring assembly 10 to smooth any wrinkles in the fabric flap 28 and to tension the side cover 26 across the box spring assembly.

A stapler 100 is positioned downstream of the fabric tensioning roller 96. Stapler 100 has a staple driving anvil 102 on the bottom thereof. The stapler 100 is supported by a bracket 104 attached to subframe 84. When the box spring assembly 10 comes into close proximity to the stapler 100, the stapler begins driving staples through the fabric flap 28 into the side rail 12. The method of activating the stapler 100 will be explained below.

A second drive wheel 106, downstream from the stapler 100, continues to drive the box spring assembly 10 through the attachment apparatus 32 to continue its travel along support table 30. Drive wheel 106 is attached to rotatable shaft 56 in such a manner that it rotates with shaft 56. Drive wheel 106 is also adjusted laterally across the rotatable shaft 56 so that it contacts the box spring assembly 10 in the area of the side rail 12.

The attachment subassembly 76 is located on the side of the frame 52 opposite the first attachment subassembly 74. The second attachment subassembly 76 may be of similar construction, but a mirror image of the first attachment subassembly 74. In the preferred embodiment, however, the construction can be greatly simplified by attaching all of the components to a subframe 110, which is attached directly to the frame 52. The lateral positioning side guide 112, therefore, is attached directly to the subframe 110. The lateral positioning side guide 112 also has an entrance portion 114, which is bent outward at an angle to aid in guiding the box spring 110, as it enters the attachment assembly 32. A bracket 113 holds the sheet metal fabric turning guide 116 and the fabric turning roller 118. Fabric turning roller 118, similar to fabric turning roller 92, has its axis skewed at an angle to the direction of movement of the box spring assembly. Bracket 116, again, may be spring loaded to force the fabric turning roller 118 and the fabric turning guide 116 down toward the lateral side guide 112. An entrance drive wheel 120, similar in construction to the entrance drive wheel 94, is attached to the shaft 54 to rotate with shaft 54. A fabric tensioning roller 122 is attached to the subframe 110. Again, the axis of the fabric tensioning roller 122 is skewed at an angle to the direction of travel of the box spring 10. A second stapler 124 is mounted downstream from the fabric tensioning roller 122. Stapler 124 is tied pneumatically together with stapler 100 and both operate simultaneously. A second exit roller 126 is mounted on rotatable shaft 56 similar to the manner that exit roller 106 is attached to rotatable shaft 56. Entrance drive wheel 120 and exit drive wheel 124 are adjusted laterally across their respective shafts to contact the box spring 10 in the area of side rail 14.

Figure 2:
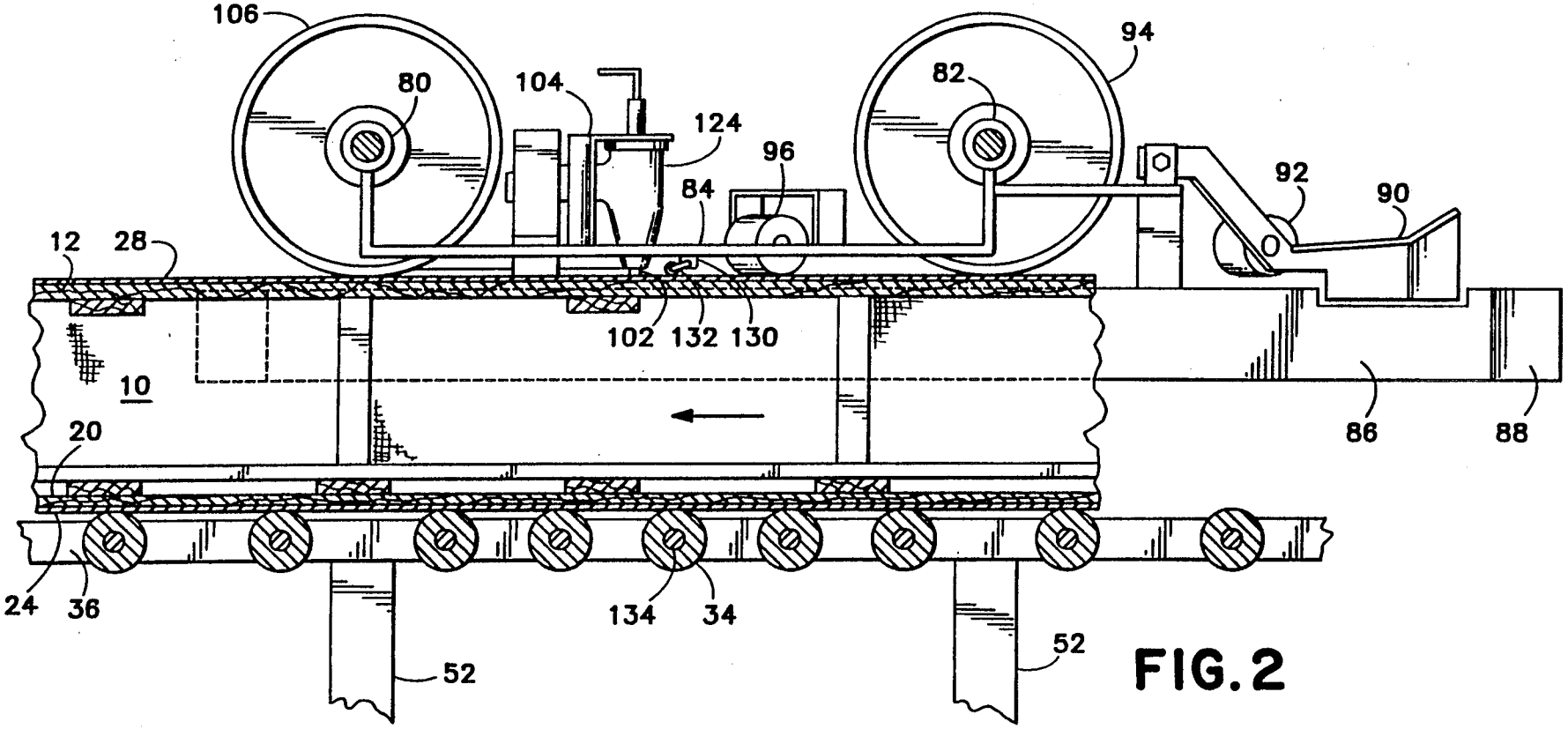
FIG. 2 is a lengthwise cross section of the table, a side view of one of the assembly mechanisms of the present invention with a partial cross-section of the box spring.

Referring now to FIG. 2, it will be noted that a microswitch 130 is located to subframe 84 downstream from the fabric tensioning roller 96, but upstream from the stapler 100. The microswitch has an arm 132, which is forced upwardly by the upper surface of the box spring 10. This microswitch activates an electrical-pneumatic relay (not shown), which allows pneumatic pressure to activate the stapler 100 which begins driving the staple anvil 102, thus forcing staples through the fabric flap 28 into the side rails 12 and 14. Once the box spring 10 has passed beyond the microswitch 130, microswitch arm 132 rotates downwardly, thus shutting off power to the staplers 100 and 124. Both staplers 100 and 124 continue to drive staples as long as the microswitch 130 is activated. The spacing of the staples along the side rail 12 of the box spring 10 is dependent upon the cycle time of the stapler and the speed at which the drive wheels 94, 120, 106 and 126 drive the box spring 10 through the attachment assembly 32. It should also be noted in FIG. 2 that the non-driven rollers 34 are supported by an axle 134.

Figure 3:
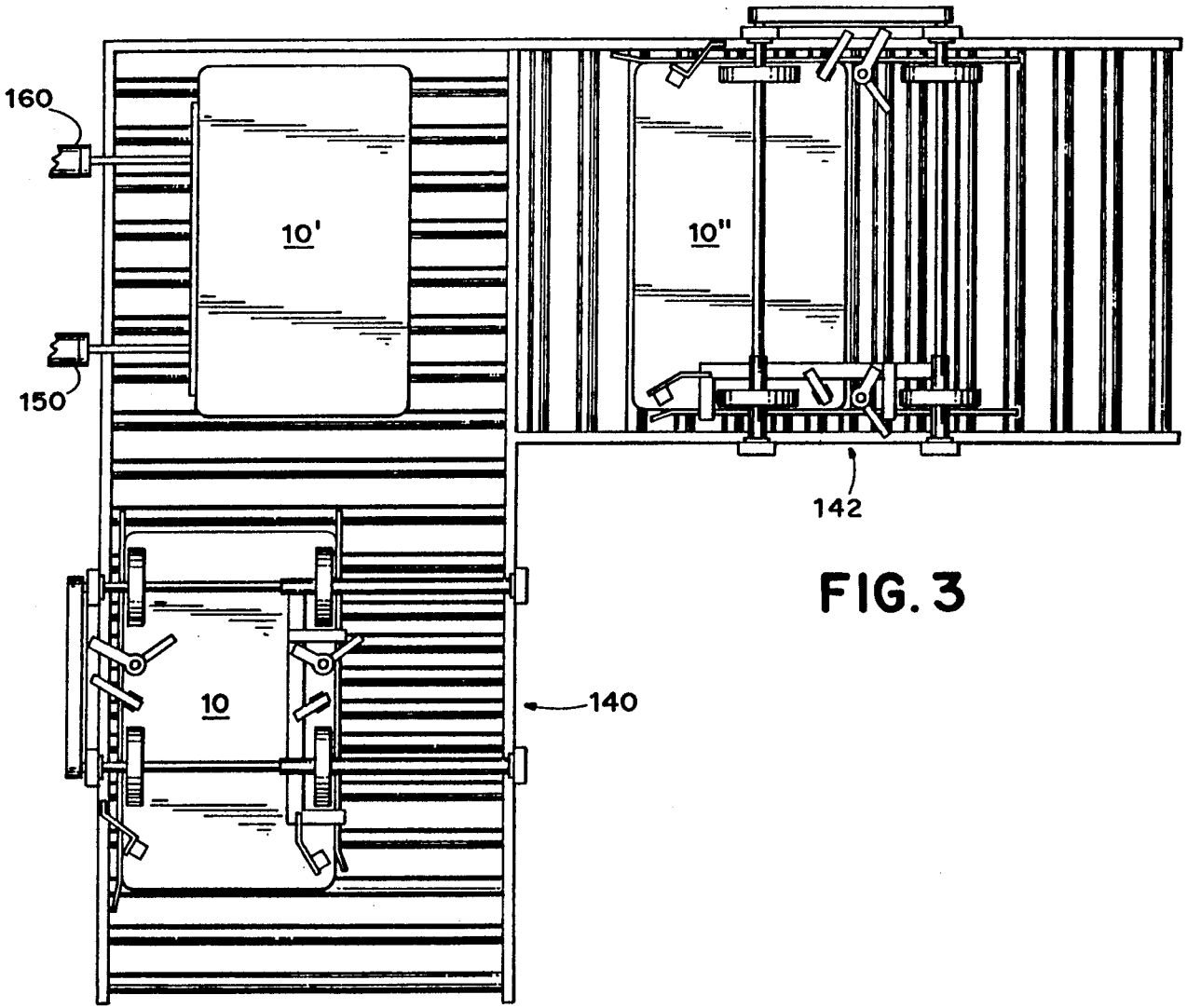
FIG. 3 is a top view of two cooperating assembly stations in accordance with the present invention to completely staple all four sides of a box spring.

The above description shows how one attachment assembly can attach a flexible covering, such as the flap of the side fabric of a box spring, to a semi-rigid member, such as a box spring. Referring now to FIG. 3, it can be seen how two of these assembly units working in conjunction can attach all four sides of a box spring. A first assembly unit 140 is configured to attach the fabric coverings to the side rails of a box spring 10 as it progresses through the assembly unit. A pair of hydraulic cylinders 150 and 160 translate the box spring 10' into a second assembly unit 142. In assembly unit 142 box spring assembly 10'' has the fabric covering attached to the top and bottom rails. Also in FIG. 3, it should be noted that any multiple of the support table rollers 34 may be driven to eliminate the need to have an operator guide the box spring into the assembly.

Operation

In operation, the framework of the box spring assembly is assembled by conventional means. In the above embodiment, the box spring assembly has a complete wooden framework. In practice, the vertical members 22, described as wooden blocks in the above embodiment, are typically replaced by coil spring assemblies. The coil spring assemblies are attached to the bottom wooden framework, indicated by side rails 12, 14 and top rail 16. The coil springs on the top surface of the box spring frame, may be merely coiled together and interconnected with a wire form framework. The frame of the box spring assembly is placed inside the inverted top cover 24 and side cover 26. The side cover is pulled up about the framework, such that it extends up so that flap 28 is in a vertical position. The inverted box spring is placed upon the support table 30 and progress toward the lateral side guides 86 and 112. The entrance portion 88 and 114 of the lateral side guides contact the sides of the box spring assembly 10 and center it into the attachment assembly apparatus. Table 30 has previously been adjusted in a vertical position to match the vertical height of the box spring to be assembled. Attachment subassembly 74 has been adjusted laterally across rotatable shafts 54 and 56, such that the spacing between the lateral guide 112 and the lateral guide 86 is equal to the width of the box spring assembly 110. It should be noted that upstream drive wheel 94 is journaled to hollow tubular member 82 and downstream drive wheel 106 is journaled to tubular hollow member 80. The drive wheel 94 and 106 are decoupled from rotatable shafts 54 and 56, respectively, and moved laterally to adjust subassembly 74. Since the hollow tubular members 80 and 82 are journaled to the drive wheels, they move in conjunction with the drive wheels. The drive wheels then are merely recoupled to the drive shafts 54 and 56 by set screws or other suitable means. Thus, by merely manipulating two set screws, the entire assembly may be adjusted for varying widths or lengths of the box spring assembly 10. Thus, a single adjustment by hand crank 44 accommodates varying heights or thicknesses of box spring springs 10, while single adjustments of the drive wheels 94 and 106 accommodate various widths or lengths of box spring 10.

Of course, it should be understood that a wide range of changes and modifications can be made to the preferred embodiments described above. It is, therefore, intended that the foregoing descriptions be regarded as illustrative rather than limiting, and that it be understood that it is the following claims, including all equivalents, which are intended to define the scope of the invention.

I/We claim:

1. An apparatus for attaching a flexible covering to a semi-rigid member comprising:

a support means to support a semi-rigid member;

a drive means to transport the semi-rigid member along said support means, said drive means being located above said support means;

a folding means to turn the flexible covering down upon the semi-rigid member to form a flap overlying a rigid portion of said semi-rigid member;

a tensioning means to smooth the flap against the rigid portion of said semi-rigid member to eliminate wrinkles in the flap; and a fastening means to attach the flexible covering to the semi-rigid member;

said support means including a table, an adjustment means to adjust the table in a vertical plane, and a plurality of low friction rollers spaced horizontally across said table to provide a low friction support surface.

2. An apparatus for attaching a flexible covering to a semi-rigid member comprising:

a support means to support a semi-rigid member;

a drive means to transport the semi-rigid member along said support means, said drive means located above said support means;

a folding means to turn the flexible covering down upon the semi-rigid member to form a flap overlying a rigid portion of said semi-rigid member, said folding means including a guide and a non-driven roller, said non-driven roller being mounted at an angle to the direction of travel of the semi-rigid member and being actuated by rolling contact with said semi-rigid member as said semi-rigid member is transported along said support means;

a tensioning means to smooth the flap against the rigid portion of said semi-rigid member to eliminate wrinkles in the flap; and a fastening means to attach the flexible covering to the semi-rigid member.

3. An apparatus for attaching a flexible covering to a semi-rigid member as recited ion claim 2, wherein said tensioning means includes a tensioning roller adapted to contact the flexible covering lying on the semi-rigid member, said tensioning roller positioned at an angle to the direction of travel of said semi-rigid member.

4. An apparatus for attaching a flexible covering to a semi-rigid member as recited in cl aim 2, wherein said fastening means includes a pair of staplers, said staplers driving staples through the flexible covering into the semi-rigid member.

5. An apparatus for attaching a flexible covering to a semi-rigid member comprising:

a frame;

a pair of rotatable shafts supported by said frame;

a pair of drive wheels attached to each shaft;

a motor means to rotate said shafts;

a pair of subframes supported from said shafts adjacent said drive wheels;

a side guide attached to each subframe, said side guides having an entrance portion as an integral part thereof, said side guides projecting between and beyond the drive wheels;

an entrance fabric folding guide attached to each subframe upstream of said drive wheels;

a tensioning means to stretch the fabric about the semi-rigid member, said tensioning means being attached to each subframe between said drive wheels;

a stapler attached to each subframe between said drive wheels downstream of the tensioning means;

a switch means to detect the presence of the semi-rigid member;

a control means to activate the staplers in response to said switch means;

an adjustment means to laterally adjust said drive wheels and said subframes across said shafts to accommodate different width semi-rigid members;

a table mounted inside said frame, below said drive wheels, said table supporting said semi-rigid member; and a vertical adjustment means to vertically position said table for different thickness semi-rigid members, to bring said semi-rigid member in contact with said drive wheels for translation of the semi-rigid member by the drive wheels.

6. An apparatus for attaching a flexible covering to a semi-rigid member as recited in claim 5, wherein said tensioning means is comprised of a tensioning roller mounted at an angle to the direction of travel of the box spring.

7. An apparatus for attaching a flexible covering to a semi-rigid member as recited in claim 5, wherein said switch means includes a switch having an arm which is contacted by the semi-rigid member as the semi-rigid member travels along said support table.

8. An apparatus for attaching a flexible covering to a semi-rigid member as recited in claim 5, wherein said vertical adjustment means includes a plurality of cooperating jacks.

* * * * *